US009606475B2

(12) United States Patent
Op de Beeck et al.

(10) Patent No.: US 9,606,475 B2
(45) Date of Patent: Mar. 28, 2017

(54) METHOD OF DIGITALLY PRINTING AND A DIGITAL PRINTING SYSTEM

(71) Applicant: Xeikon IP B.V., Eede (NL)

(72) Inventors: Werner Jozef Johan Op de Beeck, Putte (BE); Wim Libaers, Boortmeerbeek (BE); Lode Erik Dries Deprez, Wachtebeke (BE)

(73) Assignee: Xeikon IP B.V., Eede (NL)

( * ) Notice: Subject to any disclaimer, the term of this patent is extended or adjusted under 35 U.S.C. 154(b) by 0 days.

(21) Appl. No.: 14/916,342

(22) PCT Filed: Sep. 4, 2014

(86) PCT No.: PCT/NL2014/050601

§ 371 (c)(1),
(2) Date: Mar. 3, 2016

(87) PCT Pub. No.: WO2015/034353

PCT Pub. Date: Mar. 12, 2015

(65) Prior Publication Data

US 2016/0195834 A1 Jul. 7, 2016

(30) Foreign Application Priority Data

Sep. 4, 2013 (NL) ..... 2011380

(51) Int. Cl.

| | |
|---|---|
| ***G03G 15/10*** | (2006.01) |
| ***G03G 15/11*** | (2006.01) |
| ***G03G 21/00*** | (2006.01) |

(52) U.S. Cl.
CPC ..... *G03G 15/11* (2013.01); *G03G 21/0088* (2013.01)

(58) Field of Classification Search
USPC ..... 399/119, 120, 222, 237, 249
See application file for complete search history.

(56) References Cited

U.S. PATENT DOCUMENTS 5,561,264 A * 10/1996 Iino ..... G03G 15/101 399/240
5,991,581 A * 11/1999 Kwak ..... G03G 15/101 399/237
6,317,578 B1 * 11/2001 Kusayanagi ..... G03G 15/101 399/249

(Continued)

FOREIGN PATENT DOCUMENTS

EP 1473602 A1 11/2004
EP 2685320 A1 1/2014

(Continued)

*Primary Examiner* — Hoan Tran
(74) *Attorney, Agent, or Firm* — The Webb Law Firm

(57) ABSTRACT

The printing method includes the steps of (1) Transferring after charging a charged liquid developer dispersion from a surface of the first member optionally via the at least one further member to a substrate, wherein excess liquid developer dispersion remains present on the first member after the transfer; (2) Treating the excess liquid developer dispersion so as to facilitate its removal from the first member (3) removing, at least substantially, the treated excess liquid developer dispersion from the surface of the first member using a removal device, and (4) upon interrupting or terminating the printing, removing material adhered to the removal device.

20 Claims, 3 Drawing Sheets

(56) References Cited

U.S. PATENT DOCUMENTS

| | | | | |
|---|---|---|---|---|
| 6,868,246 | B2 * | 3/2005 | Takeuchi | G03G 15/104 399/237 |
| 8,588,655 | B2 * | 11/2013 | Berg | G03G 15/104 399/237 |
| 2004/0234309 | A1 | 11/2004 | Nagata et al. | |
| 2007/0223980 | A1 | 9/2007 | Fukumoto et al. | |
| 2011/0249990 | A1 | 10/2011 | Izawa et al. | |
| 2014/0016966 | A1 | 1/2014 | Devlieghere et al. | |
| 2014/0016976 | A1 | 1/2014 | Horemans et al. | |
| 2014/0301756 | A1 | 10/2014 | Gijsbrechts et al. | |

FOREIGN PATENT DOCUMENTS

| | | | |
|---|---|---|---|
| EP | 2685322 | A1 | 1/2014 |
| JP | 8110741 | A | 4/1996 |
| JP | 200329589 | A | 1/2003 |
| JP | 201195557 | A | 5/2011 |
| NL | 2010581 | C | 10/2014 |

* cited by examiner

METHOD OF DIGITALLY PRINTING AND A DIGITAL PRINTING SYSTEM

CROSS-REFERENCE TO RELATED APPLICATIONS

This application is the United States national phase of International Application No. PCT/NL2014/050601 filed Sep. 4, 2014, and claims priority to Dutch Patent Application No. 2011380 filed Sep. 4, 2013, the disclosures of which are hereby incorporated in their entirety by reference.

FIELD OF THE INVENTION

The invention relates to a method of digitally printing, wherein use is made of a first member that rotates during printing, which printing method comprises the steps of:

Transferring a liquid developer dispersion from a surface of the first member via at least one further member to a substrate, wherein excess liquid developer dispersion remains present on the first member after said transfer especially in non image or non printing areas;

Removing, at least substantially, the (optionally treated) excess liquid developer dispersion from the surface of the first member by means of a removal device.

The invention further relates to a digital printing system comprising:

a first member which is in use rotating and in rotational contact with a further member, said first and said further member being configured for transferring liquid developer dispersion from the first member via said further member to a substrate, wherein excess liquid developer dispersion remains present on the first member after transfer to said further member;

removal device for removing of the excess liquid developer dispersion from the first member.

BACKGROUND OF THE INVENTION

Digital printing apparatus using liquid development dispersion—also known as liquid toner—are known from US patent application publication no. 2011/0249990. The known digital printing apparatus comprises a feed roller, a developer roller, a cleaning roller in rotational contact with the developer roller, and an image carrying roller; the feed roller being arranged to transfer a quantity of liquid toner from a reservoir onto the developer roller; and the developer roller being arranged to transfer a portion of the quantity of liquid toner onto the image carrying roller in accordance with a charge pattern sustained on a surface of said image carrying roller. A liquid toner residue, also referred to as an excess liquid developer dispersion, remains on (the surface of) the developer roller after the imagewise transfer of the liquid toner from the development roller to a further roller, particularly the imaging roller.

In digital printing systems of this kind, it is necessary to remove the liquid toner residue that remains on the surface of the developer roller after contact with the imaging roller. Any liquid toner residue that remains on the surface of the imaging roller after contact with a transfer roller or on the transfer roller after contact with a substrate is preferably removed as well.

It is observed that these highly concentrated and therefore highly viscous compacted toners are not easily de-compacted and removed from rollers. Thus, the removal of such a residue can be quite challenging. Particularly, marking particles in the liquid development dispersion tend to form lumps in the dispersion resulting in a liquid with a non-uniform distribution of marking particles. This is called caking and often results in an increase of the viscosity of the liquid dispersion. This viscosity increase is significant, and could be a tenfold increase or even more. Liquid developer dispersion that shows caking cannot be used for printing as such and needs to be treated first in order to re-obtain a homogeneously dispersed liquid toner which has similar physical properties like conductivity and viscosity as the starting liquid developer dispersion. It is thought that caking is the result of marking particles that come so close into each other's neighborhood on the developing member, so that they start to feel each other's presence and start interacting with each other Caking can also be the result of injecting charge and applying high shearing forces which are typically present when a thin layer of liquid developer dispersion passes through a very narrow gap between two (rotating) members of the printing apparatus or huge (microsized) mechanical interaction like a cleaning blade scraping on a circular surface.

The removal of the liquid toner residue starts then to be problematic. As a result, a part of the liquid toner residue could remain on the development roller, which constitutes a contamination and may lead to a non-uniform distribution of fresh developer dispersion resulting in a ghost image and/or image quality that is not perfect, in other words incorrect. Specific examples of issues are density instability and incorrect reproduction of fine lines or loss in colour density. Removal of the toner residue by a removal device may reduce the issue, but is not known to solve the issue completely. It is therefore a major problem to solve the caking issue.

The solution known from US2011/0249990A1 resides in the use of a specific removal device, i.e. a cleaning roller, as well as cleaning blades on the development roller and on the cleaning roller. However, it is not clear that all residue is removed from the development roller with the cleaning roller and the subsequent cleaning blade. As a consequence, there is a risk that some residue remains on the development roller, and may cause trouble in a subsequent loading of the development roller with fresh liquid developer dispersion.

It is an object of the invention to provide an improved printing method and an improved printing system of the types mentioned in the opening paragraphs, which are less susceptible to the consequences of caking.

It is an another object of this invention to prevent residue in the area downstream of the removal device, such as the said cleaning roller and cleaning blade, so that no high viscosity residue remains in the areas downstream of such between the removal device and the area of reloading the first member. Such area is for instance a tank with fresh liquid developer dispersion.

SUMMARY OF THE INVENTION

According to a first aspect, the invention relates to a process of digitally printing, wherein:

excess liquid developer dispersion remains in non-image areas on a development member after transfer of charged liquid developer dispersion to an imaging member so as to create an image on the imaging member, which development member and which imaging member are mutually in rotational contact during said transfer, which excess liquid developer dispersion is removed from the development member by means of a removal device, and the removal device is rinsed, upon interruption or termination of the transfer, with fresh liquid developer dispersion applied on the development member that rotates without being in rotational contact with said imaging member.

According to a second aspect of the invention, this object is achieved in a method of digitally printing, wherein use is made of a development member that rotates during printing, which printing method comprises the steps of:

Charging a liquid developer dispersion to facilitate transfer thereof from the development member to an imaging member;

Transferring the charged liquid developer dispersion from a surface of the development member via the imaging member and optionally via at least one further member to a substrate, wherein sometimes excess liquid developer dispersion remains present on the development member after said transfer;

Treating the excess liquid developer dispersion so as to facilitate its removal from the first member, Removing, at least substantially, the treated excess liquid developer dispersion from the surface of the development member by means of a removal device, and upon interrupting or terminating the printing, removing material adhered to the removal device and the areas behind, wherein the removal device is rinsed, upon interruption or termination of the transfer, with fresh, uncharged liquid developer dispersion applied on the development member that rotates without being in rotational contact with said imaging member.

According to a third aspect of the invention, the object is achieved in a digital printing system comprising:

a reservoir for liquid developer dispersion;

an imaging member;

a development member which is in use rotating, said development and said imaging member being configured for transferring charged liquid developer dispersion from the development member via said imaging member to a substrate, wherein excess liquid developer dispersion remains present on the development member after transfer to said imaging member;

a removal device for removing of the excess liquid developer dispersion from the first member;

application means for application of a rinsing liquid for rinsing the removal device, wherein the system is configured to have a first and a second state, in which first state the development member is in rotational contact with the imaging member and configured for transferring charged liquid developer dispersion to the imaging member, in which second state the development member is free of rotational contact with the imaging member and configured for transferring liquid developer dispersion to the removal device.

According to again a further aspect, the invention relates to the use of any of the above mentioned printing systems so as to obtain stable printing without need for frequent and unexpected interruption due to accumulated toner residue.

According to again a further aspect, the invention relates to the prevention of accumulation of some excess liquid developer dispersion on a removal device through use of a rinsing liquid, which is a fresh liquid developer dispersion, for the rinsing of a removal device upon interruption of termination of printing, which removal device is arranged to be at least substantially in contact with a development member of a printing system, that rotates and is in rotational contact with an imaging member during printing and is configured for transferring charged liquid developer dispersion according to a desired image and for retaining excess liquid developer dispersion, until removal thereof from the development member by means of the removal device.

The invention was developed on the basis of investigations, wherein a prior art printing system was improved to contain treatment means. A variety of such treatment means are described in the non-prepublished applications EP 12 175 762.9, EP13162577.4 and NL2010581 in the name of the Applicant, which are herein included by reference. It turned that the efficiency of the improved printing system that is provided with treatment means so as to reduce caking, depends on the manner of operation. When the printing was carried out continuously, no problem occurred. However, when the printing was frequently or regularly interrupted, for instance a couple of times per hour or per day, and therewith the first member did no longer rotate, printing problems started to occur after a while. As a result, the printing had to be interrupted very often to remove accumulated material on the removal device.

The inventors of the present invention have found that a more stable printing process could be obtained by removal of accumulated material from the removal device particularly. The inventors believe that the excess liquid developer dispersion is sufficiently homogeneous to be removed, particularly after the treatment to facilitate removal, but still can be too high in viscosity due to non-Newtonian behaviour, that developer dispersion adheres to said removal device, when interrupting the rotation of the first member. This non-Newtonian thixotropic behaviour results in a high viscous jelly structure, which becomes hard to remove after a while and start to form layers on top of each other. The jelly structure becomes particularly hard to remove when—subsequently toner residue adheres thereto. This issue may be prevented by removing the material adhered to the removal device upon interruption of printing, i.e. intermittently rather than continuously.

According to the invention, the removal of the adhered material is carried out by application of a rinsing liquid.

Herein, the rinsing liquid is applied to the removal device via the development member. The rinsing liquid is applied to the development member directly. The liquid developer dispersion is used as the rinsing liquid. This use has the advantage that the rinsing liquid will not dilute or change the composition at the development member and particularly at any available reservoir of liquid developer dispersion. The use of liquid developer dispersion is deemed most beneficial in combination with flushing. It has been observed that even if such liquid developer dispersion would remain attached to the development member and/or the removal device, this does not do any significant harm because of the low viscosity of this dispersion.

Most preferably, the (fresh) liquid developer dispersion has not undergone any charging treatment and is therefore less sensitive to caking or "cake-less" or "cake-free". Even if particles in the developer dispersion would adhere to the development member or the removal device, they are most likely taken up in the developer dispersion when rotation of the development member is restarted, because the developer dispersion is more uniform and has a lower viscosity. Thereto, in a preferred embodiment, the method comprises a step of charging the fresh liquid developer dispersion prior to transfer to the imaging member, and the system comprises means for such transfer. Suitably, the charging means are controlled, so that no charging is provided when the liquid developer dispersion is not transferred to the imaging member but used for rinsing the removal device.

The system configuration to operate in either a first state or a second state may be embodied in various manners. Preferably either one of the imaging or the development member is moved relative to the other one. In a highly preferred embodiment of the method of the invention resides therein that the method further comprises, upon interrupting or terminating the printing, the steps of:

Separating the development member from the imaging member to avoid transfer of liquid developer dispersion from the development member to the imaging member;

Loading liquid developer dispersion onto a surface of the development member;

Transporting the loaded liquid developer dispersion without an intermediate charging and/or decharging step to the removal device.

This embodiment is preferred in that the liquid toner available in the reservoir is used, without the need for further application means. The separation of the development member from the imaging member has the effect that no transfer of liquid toner will take place. Thus particularly, the arrangement of either the development member or the imaging member or both is at least slightly changed, in a manner further known to the skilled person. The absence of intermediate charging is for instance achieved by switching off the charging means, and most suitably also any decharging means and any electrical field present between the rotating and coupled rollers. It is herewith ensured that the fresh liquid developer dispersion remains homogeneous and uncharged. Thereto, a control means will provide appropriate control signals to the respective means. It is furthermore deemed beneficial that the development member is moved rather than that the imaging member is moved relative.

The means for separation of the development member may be moving means for positioning the development member, in the first state (and position) or in the second state (and position), and suitably in a further state. Alternatively, the separating means may be independent from any positioning means, and configured for overcoming an elastic force of the development member to be retained in rotational contact with the development member, to bring the development member in the second state. As soon as the means for separating stop, the development member will return to its first state in rotational contact with the imaging member.

In a suitable implementation, the removal device is physically coupled to the same frame as the development member, such that upon separating the development member from the imaging member, the removal device will move with the development member. In this manner, the distance between the removal device and the development member is kept constant. Alternatively, the development member could be removed such that the distance to the removal device remains constant. Such removal is more particularly a removal in another direction than the direction defined by a straight line between the removal device and the point of contact between development member and imaging member.

Suitably, a collector is present for collecting the toner residue removed from the removal device. This collector may be specific to the removal device. Alternatively and preferably, this collector is the container also used to collect any excess liquid developer dispersion during printing.

In order to apply the procedure for removal of adhered material intermittently, upon interruption or termination of printing, the system of the invention is provided with control means. These control means obtain information on the interruption or stopping of printing, for instance on the basis of a user input, in case of an interruption due to a failure or error, such as for instance no availability of substrate, or after finalizing of a specified printing programme. The term "upon interruption" is understood in the context of the present invention, to any moment simultaneously with the interruption or shortly thereafter, or shortly in advance thereof, if known by the control means. Preferably, in regular operation, the removal of the adhered material starts within 30 seconds after interruption, more preferably within 15 seconds, and even more preferably within 5 seconds after interruption. It will be understood that in cases of failure or service mode, the removal of adhered material may start later. In such a situation, furthermore, a more elaborated removal procedure may be carried out if deemed necessary.

In addition to the removal of adhered material upon interruption or termination of printing, it is deemed advantageous to carry out a pre-treatment with rinsing liquid upon starting the printing, or directly prior to starting printing. As the rinsing liquid, the fresh liquid toner is used again, preferably without application of any charging or discharging operation. More preferably, no transfer of such fresh liquid toner to the imaging member occurs. Such "starting sequence" is particularly aimed at creating a flow of rinsing liquid over sensitive areas of the development member and the removal device. More particularly, such starting sequence is aimed at creating a surface layer of a material that is known in the process. Due to the provision of such a surface layer, adhesion to an underlying surface is understood to reduce, resulting in a better flow. One specific implementation is based on the provision of This specific implementation is deemed most beneficially applied on the development member.

Particularly, the rinsing liquid is used in such an amount so as to flush the removal device. In the context of the present application, the term 'rinsing' refers to the provision of a rinsing liquid in a volume sufficient to achieve a clean the removal device from any retained toner residue. This may be based on active removal but also on viscosity reduction of the retained toner residue. Particularly, the viscosity reduction is such so that remaining excess dispersion is able to move down from the removal device and the areas behind it and/or to remain fluidic or lowly viscous until restart of rotation of the development member.

The term 'flushing' is understood as one embodiment of rinsing, wherein an excess of rinsing liquid is used. The mechanism may here be based, at least partially, on quasi-mechanical removal of the toner residue from the removal device, rather than primarily on the basis of solubility increase and/or viscosity reduction.

The term 'rinsing liquid' is to be understood, in the context of the present invention as a composition that is at least primarily liquid and able to flow over a surface. It is a dispersion, which is homogeneous, and more particularly not subjected to any charging or to an electrical field. More particularly, the rinsing liquid is the fresh liquid developer dispersion itself, which is not subjected to any electrical field and/or charging.

The term 'material adhered to the removal device' refers to components of excess liquid developer dispersion that adhere to the removal device due to their viscosity. It will be understood, in the light of the behaviour of such excess liquid developer dispersion that has been increased in solid content, that the term 'adhered material' is understood also to refer to any material on the removal device with a viscous, slow flow.

The term 'non-image areas' is used to refer to any area on the development member outside the image area, from which the charged liquid developer dispersion is transferred, preferably substantially completely, to the imaging member. Transfer occurs in the non-image areas as well, but—under normal operation mainly only of the carrier liquid phase of the compacted charged liquid developer dispersion.

Additionally, use may be made of mechanical means for removing the adhered material from the removal device. The mechanical means is for instance embodied as a wiper or vibrating means on the removal device. Such wiper may be located in a first location when being idle, being actuated to clean the removal device upon interruption of rotation of the development member. The wiper suitably comprises a wiping surface that is inert to the toner residue and is more preferably non-porous and smooth. The wiper is furthermore provided with a shaping matching the relevant surface of the removal device, and/or is sufficiently flexible so as to match said surface.

In a preferred embodiment, the excess liquid developer dispersion is treated so as to facilitate its removal from the development member. The treatment of facilitating removal of the toner residue may be any treatment that is known to the skilled person or described in one or more of the above mentioned non-pre-published applications in the name of Applicant, such as decompaction, rubbing, addition of dispersing agent.

Suitably, the treatment for facilitating removal of the toner residue comprises the addition of a dispersing agent. More suitably, this dispersing agent is first added to an additional member that is, in use, in rotational contact with the first member, and is then transferred from the additional member to the first member. Such an indirect addition has been found to ensure that the dispersing agent is effectively added and mixed to the more viscous developer dispersion.

More preferably, the additional member is a loosening member with a rubbing portion at its surface. Addition of the dispersing agent in this manner turns out to ensure that the dispersing agent is effectively mixed with the developer dispersion. Particularly, the rubbing portion is understood to rub the developer dispersion, and therewith, if really caked, provide cracks and/or adjacent portions of such developer dispersion. It furthermore appears that the rubbing portion is compressed, such that part of the developer dispersion may be absorbed into pores of the rubbing portion and thereafter be released again.

The rubbing portion suitably comprises an elastic material, for instance an elastic foam material. Suitably, the elastic foam material is not or not substantially sensitive to swelling by the carrier liquid. One preferred embodiment is a cellular foam material. The density of the material of the rubbing portion is suitably smaller than 150 kg/m$^3$, preferably smaller than 100 kg/m$^3$, more preferably smaller than 75 kg/m$^3$, for instance between 30 and 50 kg/m$^3$.

The material for instance comprises polyurethane foam, silicone foam, viscose, rubber, Teflon, polyolefine foam, such as polyethylene foam, polysiloxanes, such as polydimethylsiloxane (PDMS).

Suitably, the rubbing portion may be provided at the surface with holes, cavities, or channels configured for containing liquid toner during compression. In that way, also non-foam materials may be used to obtain similar effects. The surface of the rubbing portion could e.g. be provided with slits or channels or perforations in which liquid toner present on the first member can enter upon contact with the rubbing portion.

Furthermore, the loosening member may be a brush roller with bristles to mechanically break up toner particle aggregates that may be formed as a result of physical and electrophoretic compaction. The bristles are adapted to contain the liquid toner while being pressed against the first roller, and to perform a rubbing action on the liquid toner. Suitably, an actuator is present for moving the loosening member such that liquid toner absorbed or contained in or on the rubbing portion is rubbed during the movement of the loosening member. This movement could e.g. be a rotational movement around a rotation axis parallel to a rotation axis of the first member, and/or an axial movement parallel to the surface of the first member and/or a movement perpendicular to the surface of the first member. According to a preferred embodiment, the loosening member is a rotatable member being in operation in rotating contact with the first member. The actuator may then be configured for rotating the loosening member.

According to a preferred embodiment, seen at an area of contact between the first member and the loosening member, the loosening member rotates in an opposite direction, compared to the first member. In that way, a liquid pickup zone is created upstream of the area of contact between the first member and the loosening member, and a squeeze-out zone is created downstream of said area of contact. Such an embodiment has the advantage that the loosening member also fulfils the function of picking up liquid toner from the first roller, as well as of removing the picked up liquid toner from the loosening member. In preferred embodiments, the contact between the first member and the loosening member is such that a nip is created between the first member and loosening member. When a quantity of liquid present on the first member arrives at the nip, it will be taken up in the nip, and rubbed and agitated in the nip as a consequence of the counter rotating loosening member. The loosened liquid toner is picked up at one end of the nip by the counter rotating loosening member, and, after a full rotation of the loosening member, is reintroduced in the nip, at the other end thereof, and squeezed out of the rubbing portion.

Preferably the loosening member is a roller, and the rubbing portion is provided as a cylindrical outer layer of the roller. The thickness of this cylindrical outer layer is preferably more than 3 mm. The first member may have a first rotational speed which is different from a rotational speed from the loosening member. Typically, the speed of the loosening member will be chosen so that a good compromise is obtained between performance and wear behaviour. Preferably, the absolute value of the speed of the loosening member is larger than 0.20 times the absolute value of the speed of the first member, e.g. between 0.20 and 1.0 times the speed of the first member.

Furthermore, the development member is most suitably a cylindrical member, such as a roller.

In again a further embodiment, the system is provided with means for regenerating fresh liquid developer dispersion from the dispersion removed via the removal device. The means suitably comprises mixing means for (fully) dispersing excess liquid developer dispersion. The means furthermore may contain adding means, for instance to add carrier liquid, dispersing agent and/or marking particles, so as to prepare a liquid developer dispersion which meets settings and requirements for fresh liquid developer dispersion with respect to, for instance, concentration of marking particles and viscosity. Such means suitably comprises the collector mentioned before, and typically a first and a second collector or container or vessel. Since the flow rate of (excess) liquid developer dispersion removed with the removal device may vary over time, in dependence of the pattern transferred to the imaging member and of the operation state, the first vessel is suitably configured to maintain a constant volume. For instance, use is made of a level sensor, and transfer means for liquid from the first vessel to a second vessel that are controlled on the basis of the sensed level. It is further feasible that the inflow of liquid developer dispersion into the first vessel is controlled. For instance, in case of rinsing, the liquid developer dispersion may be directly added into the second vessel.

BRIEF INTRODUCTION OF THE FIGURES

These and other aspects of the invention will be further elucidated with reference to the figures, wherein.

DETAILED DESCRIPTION OF ILLUSTRATED EMBODIMENTS

Figure 1:
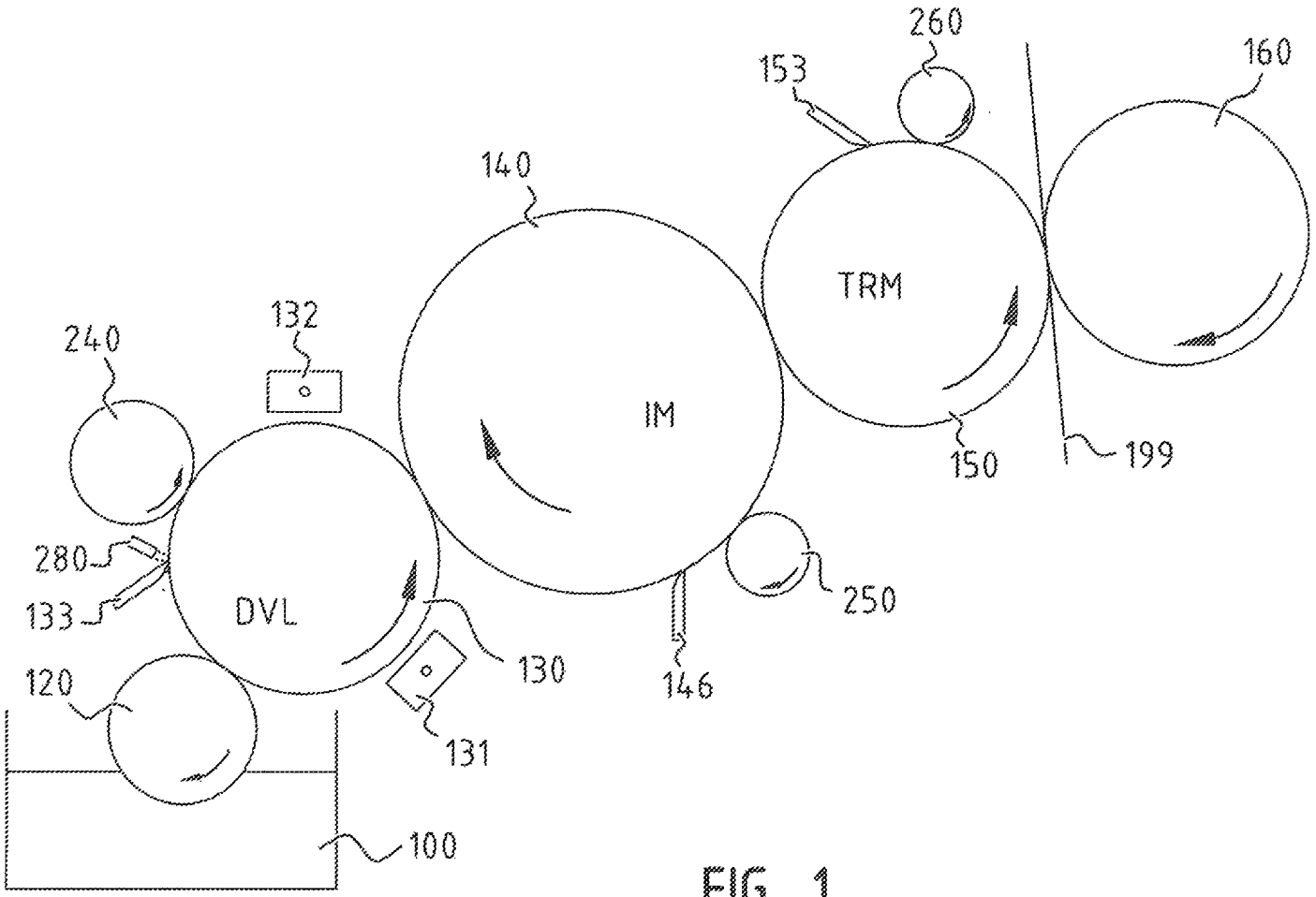
FIG. 1 is a schematic view illustrating a first embodiment of the invention.

The Figures are not drawn to scale and purely diagrammatical in nature. Equal reference numerals in different Figures refer to equal or corresponding features.

FIG. 1 illustrates in schematical view a first embodiment of a digital printing apparatus of the invention, comprising a reservoir 100, a feed member 120, a developer member 130, an imaging member 140, an intermediate member 150 and a support member 160. A substrate 199 is transported between intermediate member 150 and support member 160. Both the development member 130 and the imaging member 140 and also the intermediate member 150 can function as the first member according to the invention. In the example of FIG. 1, Each of them is provided with a removal devices 133, 146, 153, and with treatment means 240, 132, 250 and 260. Without loss of generality, the aforementioned members are illustrated and described as rollers, but the skilled person understands that they can be implemented differently, e.g. as belts.

In operation, an amount of liquid developer dispersion, initially stored in a liquid developer dispersion reservoir 100, also called main reservoir, is applied via a toner supply member 120, to a development member 130, an imaging member 140, and an optional intermediate member 150, and finally to a substrate 199. The development member 130, imaging member 140, and intermediate member 150 all transfer part of the liquid developer dispersion adhering to their surface to their successor; the part of the liquid developer dispersion that remains present on the member's surface, thus the excess liquid developer dispersion is removed after the transfer stage by appropriate means. These means are schematically illustrated as respective removal devices 133, 146, 153.

An important element in the operation of a printer based on liquid toner, is the charging of the toner (also referred to as liquid developer dispersion). The charging is carried out by means of charging means 131, such as a corona charger or a biased roll. In the illustrated example, a corona charger 131 is provided opposite to the developer roller 130, downstream of an area of rotational contact between the feed roller 120 and the developer roller 130, and upstream of an area of rotational contact between the imaging roller 140 and the developer roller 130. In fact, the charging results in microstructural changes to the liquid toner such that the desired image is selectively transferred from the development member 130 to the imaging member 140. Particularly, the charging tends to divide the liquid developer dispersion over a first layer that is richer in marking particles and is located at the surface of the development member 130, and into a second, outer layer that is richer in carrier liquid. The resulting microstructural change is also referred to as "compacting". The latent image on the development member 130 becomes a physical image (i.e. pattern) on the imaging member 140 due to the selective transfer and is thereon sustained. The selective transfer is therein achieved in that pixels on the imaging member 140 selective attract or repulse the charged toner on the development member 130. This process with its embodiments is well known to the skilled person.

In this invention, when is referred to a concentration of "liquid developer dispersion" it refers to a concentration wherein the liquid developer dispersion has a solid content so that it can be used as such in a digital printing process. In other words, the liquid developer dispersion according to the invention has a solid content that is at working strength and does not require a dilution. A typical solid content of a liquid developer dispersion is a solid content of between 10 to 30 wt %, such as a solid content of 25 wt %. According to this invention, "solid content" means the amount of marking particles in wt % with regard to the total liquid developer dispersion. According to this invention, "excess liquid developer dispersion" is the liquid developer dispersion that remains present on the surface of a member, such as the developing member, after a part of liquid developer dispersion has been transferred to another member, such as the imaging member.

Upon transfer of the liquid developer dispersion from the development member 130 to the imaging member 140, excess liquid developer dispersion is left on the development member 130. Ideally, this excess liquid developer dispersion is present only in the non-image areas. However, it is not excluded that a thin layer remains on the development roller 130 at the area of the transferred image. The physicochemical state and rheology of the excess liquid developer dispersion is influenced by the charging and also by the concentration of the toner particles, which may have changed, i.e. increased, due to loss of carrier liquid and dispersing agent during the development step. More particularly, part of the second, outer layer that is enriched in carrier liquid is transferred to the imaging member 140 in non-image areas.

The stability of the dispersion is of particular relevance. A dispersion is most generally a system comprising two or more phases, wherein one phase (the dispersed phase) is distributed finely into the other phase (the dispersing phase). The dispersion may be stabilized by means of dispersing agents that are on the one side present in the dispersing phase and on the other side present in or coupled to the dispersed phase. If the dispersing agent is not available in sufficient amount or cannot fulfil its function, the particles of the dispersed phase tend to agglomerate. Then the dispersion is said to be or become unstable. The final result could be that the agglomerated dispersed phase becomes a sold residue that is attached to a surface. Intermediate results may also be that the size of the dispersed particles increases and/or that a partial separation between the liquid of the dispersing phase and the particles of the dispersed phase occurs, resulting in an inhomogeneous dispersion. This inhomogeneity can lead to a tremendous change in the rheology: a homogeneous dispersion mostly flows in its entirely, but the rheology of an inhomogeneous dispersion is in fact dependent on the two separate phases. In other words, the behaviour of a dispersion that becomes inhomogeneous is highly complex, and its flow behaviour is rather unpredictable without significant (experimental) investigation.

In the context of the present invention, the liquid toner is a dispersion of marking particles in a carrier liquid. The marking particles, according to this invention, comprise coloured particles (also called ink particles or pigment) and a binder resin. The binder resin is a polymer, preferably transparent, that embeds the ink particles and optionally other compounds, like melt rheological adjustment compounds or fillers. The marking particles are particles with a diameter of typically about 0.5 to 4.0 μm. The marking particles have a concentration of about 40-95% of the binder resin. Preferably a polyester resin is used as binder resin. Also other types of resin having a very low or no compatibility with the carrier liquid and dispersing agent can be used. Preferably, the resin has a high transparency, provides good colour developing properties and has a high fixing property on the substrate. The carrier liquid according to the invention, can be any suitable liquid as is known in the art, and may be silicone fluids, hydrocarbon liquids and vegetable oils, or any combinations thereof.

In one preferred embodiment, the dispersion is prepared by mixing the marking particles, the dispersing agent and the carrier liquid. In order to provide an adequate adhesion of the dispersing agent to the surface of the marking particles, a further milling step is carried out on the initially formed (pre-)dispersion. The dispersing agent is suitably of a polymeric nature, and more preferably comprises an anchoring part having a plurality of anchoring sites for adhesion to the surface of the marking particles, and one or more stabilizing part that initially extends into the carrier liquid. The stabilizing part(s) are more particularly polymeric chains of non-polar nature. The degree of polymerisation may however be limited. Exemplary chains are for instance based on olefins, such as isobutylenes, alkoxides, fatty acids. Other polymers are not excluded. The chain length is for instance up to 10 units, the individual unit may contain a chain of up to 30 carbon atoms. Such stabilizing parts could also be applied, though with less advantage in combination with a single 'head' group. The anchoring part is for instance based on a compound with a plurality of more polar sites, for instance amine, imine, alcohol, carbonyl or such groups.

The charging and/or decharging treatments may destabilize the dispersion. It appears that this would results in The concentration of toner particles (solid content) in excess liquid developer dispersion will vary depending on the amount of marking particles that need to be developed. The two most extreme situations of developing are that all the liquid developer dispersion is developed, or none of the liquid developer dispersion is developed. The latter results in a substrate without a printed image. When no liquid developer dispersion is developed and all the marking particles remain on the developing member and thus reside in the excess liquid developer dispersion, the solid content is higher than in the starting liquid developer dispersion, particularly due to the partial removal of the carrier liquid with some dispersing agent in the non-image areas. On the contrary, if all the liquid developer dispersion is developed, the excess liquid developer dispersion remaining on the developer roller will comprise almost no marking particles resulting in an excess liquid developer dispersion that mainly comprises carrier liquid. A person skilled in the art will understand that the solid content and the concentration of the carrier liquid in the excess liquid developer dispersion will vary between these two extremes depending on what needs to be developed. Typically, during the printing process a certain amount of carrier liquid is lost, because it is highly unlikely that one prints continuously 100% page coverage for all colours. Typically, the viscosity of the excess liquid developing dispersion is increased compared to the viscosity of the starting, i.e. 'fresh' liquid developing dispersion. The increase of the viscosity is due to the loss of carrier liquid and dispersing agent and due to caking. Caking causes a structural change in the liquid developing dispersion and has a significant contribution to the increase of viscosity of the excess liquid developer dispersion.

When there is referred to a concentration of dispersing agent or another compound in excess liquid developing dispersion in wt %, in this invention, than it is intended to refer to a concentration of dispersing agent or another compound compared to the weight of excess liquid developing dispersion that remains on the member, unless it is clear that something else is meant.

In accordance with one embodiment of the invention, treatment means are present for treating the excess liquid developer dispersion. The treatment of the excess liquid developer dispersion is aimed at facilitating its removal. Use can be made of an electrical treatment, so as to influence the charge in the dispersion, and therewith the stability. Alternatively, use is made of a treatment to bring changes to the viscosity. Furthermore, use can be made of mixing and adding components such as a dispersing agent and carrier liquid, to improve the dispersability of the dispersed phase.

FIG. 1 shows a discharging corona 132 is provided downstream of the area of the rotational contact between the developer roller 130 and the imaging roller 140. This discharging corona 132 is suitable for changing the charge in the dispersion in magnitude or in sign. Further, downstream of the discharge corona 132 there is provided a loosening roller 240. This is a specific means that can also be used for adding of dispersing agent, which, on the basis of its rubbing portion, results in mixing of the excess liquid developer dispersion (and any caking or residue therein) with the newly added dispersing agent. The loosening roller 240 is, in use, in rotational contact with the development member 130. Similar loosening rollers 250, 260, which could be simply addition rollers without a dedicated rubbing portion, are present in rotational contact with the imaging member 140 and the intermediate member 150 respectively. Thereafter, a removal device 133 is present.

According to a suitable embodiment of the invention, the removal device comprises a first element and a guiding member. The first element is arranged to extend to be at least substantially in contact with the first member, in this example the development member 130. A specific implementation hereof is a scraper. The guiding member is designed for guiding removed toner residue to a location away from the first member. One non-limiting implementation is a plate, but the guiding member may be shaped to guide the toner residue from the—relatively wide—first member to a container. Suitably, the guide member is designed and arranged so as to prevent that toner residue falls or moves down directly into container 100 of fresh liquid toner. Thereto, in a preferred implementation, this guide member is arranged in accordance with an angle relative to the development member. More preferably, the guide member is provided with a surface structure and/or surface coating so as to avoid any hurdles to flow of liquid. The removal device may further comprise a container, although this is more preferably a separate component in the printing system.

In experiments leading to the invention, it was found that repeated interruption of the printing process and therewith interruption of the rotation of the development member 130, resulted in a shortening of the lifetime of the printing system. More particularly, it was found that printing failures were found after a short time, as compared to the situation wherein the printing was carried out in a substantially continuous manner. Further investigations revealed that caking occurred at the removal devices 133, 146 and 153, and most particularly at the removal device 133 of the development member 130. This caking occurred both at the scraper and on the guiding member.

The inventors believe that the treated excess liquid developer dispersion has become sufficiently homogeneous to be removed from the development member 130. However, certain portions thereof, particularly the non-image areas where the solid content is higher, may face more difficulties to be removed by the scraper due their viscosity. In fact, droplets tend to be extended into long tails. This behaviour is per se known as non-Newtonian, which means that at low shear rate the viscosity is higher compared to higher shear rates. The stand-still case, after interruption, is the most extreme situation and therefore resulting in the highest viscosity. During continuous operation, this process is counteracted by the continuous "inflow" of liquid developer dispersion. However, upon interruption, this does not occur any longer, giving rise to a liquid phase which slowly becomes more jelly, particularly at the removal device.

The inventors of the present invention have therefore understood that this issue may be solved by removal of adhering toner residue from the removal device 133 and downstream areas behind that location, for instance by rinsing. More particularly, thereto, use is made of the fresh liquid developer dispersion. Furthermore, as shown in FIG. 1, use may be made of an application device 280 that is arranged at a distance from the removal device 133 and is directed to most sensitive portions of the removal device 133. In particular, a tip of the application device 280 is faced towards the development member 130. Such application device 280 that is arranged at a distance from the removal device 133 is for instance a nozzle for ejection of rinsing liquid. The application device 280 is driven herein by control means (not shown in FIG. 1), which define the timing and the volume of rinsing liquid to be applied.

In order to apply fresh liquid developer dispersion as a cleaning liquid, the development member 130 is isolated, i.e. drawn away from the imaging member 140 upon interruption. This has the effect that the development member 130 may continue to rotate without any contact with and transfer to the imaging member 140. Thereto, the development member 130 and the imaging member 140 are suitably provided with their own independent means for rotation, such as an electromotor. It is preferred in that case that no charging or discharging takes place by means of charging and discharging means 131, 132. In this manner, it is achieved that the fresh liquid developer dispersion originating from main reservoir 100 may be returned to this same main reservoir 100 in a nearly unchanged state.

Figure 2:
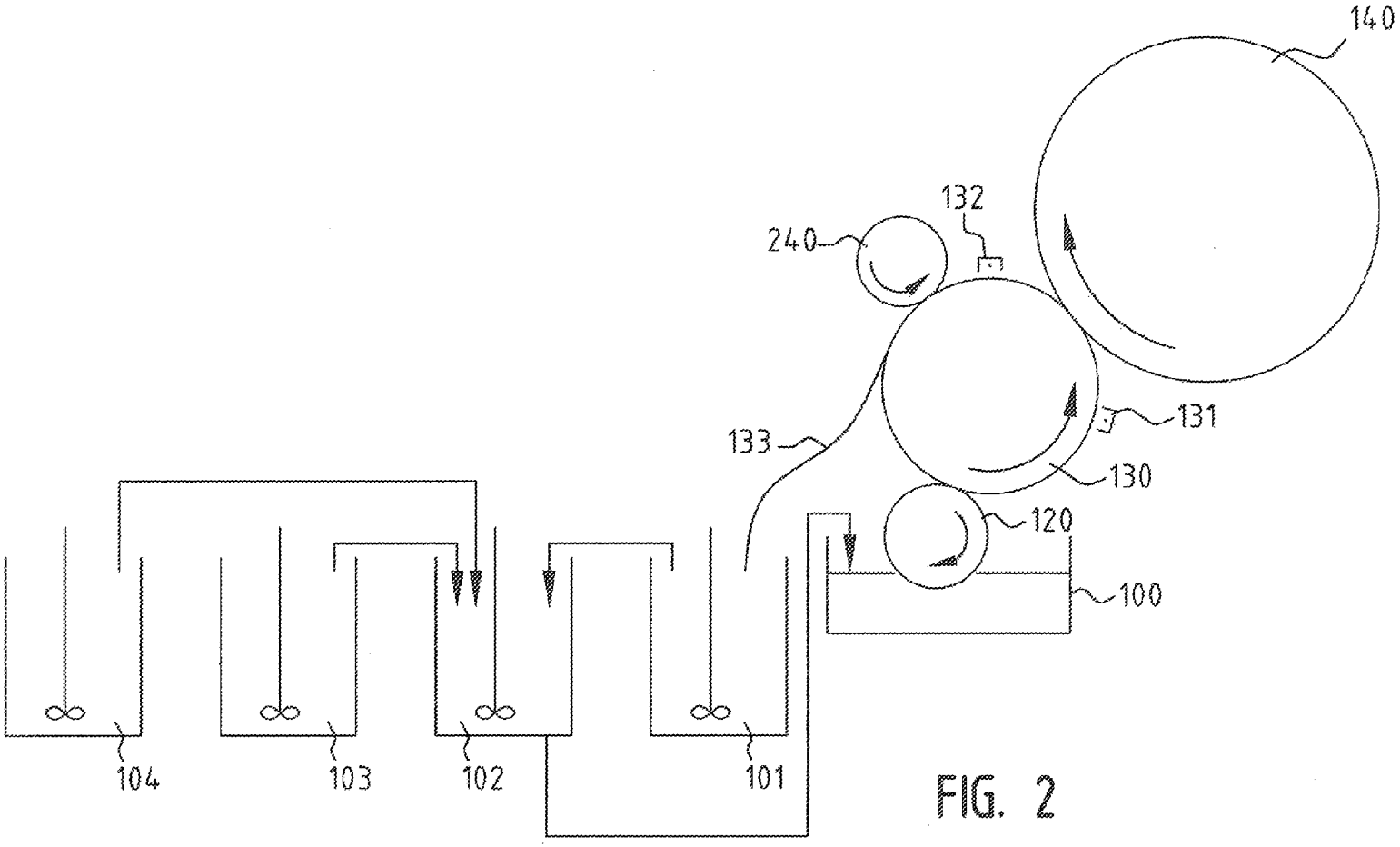
FIG. 2 is a schematic view illustrating a second embodiment of the invention.

FIG. 2 shows in schematical view an embodiment of the invention. According to this embodiment, fresh liquid toner from the container 100 is used as the rinsing liquid. In order to prevent that such fresh liquid toner is charged and/or transferred to the imaging member 140, control means (not shown) are configured for controlling the operation of the charging means 131, the treatment means for facilitating removal, such as decharging means 132 and an additional member 240. More particularly, the control means ensure that upon interruption or termination of printing, the charging means 131 and the decharging means 132 are switched off. Furthermore, the control means ensures that the development member 130 is separated and isolated from the imaging member 140 upon interruption, such that the development member 130 may continue to rotate without transfer of liquid toner to the imaging member 140. Such a separation or isolation may be achieved in known manner. The isolation and separation may further comprise switching off an electric field operating at the imaging member 140 and/or at a nip where development member 130 and imaging member 140 contact each other. An electric field, if any, between the feed member 120 and the development member 130 can also be switched of.

In according with a preferred embodiment of the invention, the development member 130 continues to rotate and to receive fresh liquid toner that is taken up from the bath 100 by the feed member 120 and then transferred to the development roller 130. Because no charging is applied by charging means 131, and because, more preferably, the liquid toner is not subjected to an electric field for transfer to the imaging member 140, no compaction occurs. Moreover, no increase in the solid content of the liquid toner occurs due to selective transfer of carrier liquid in non-image areas. As a consequence, fresh liquid toner arrives downstream, where removal device 133 is located. The fresh liquid toner then acts to rinse said removal device, therewith removing adhered toner residue which is present on the removal device 133 before it had time to slowly become jelly.

The mixture of fresh liquid toner and toner residue is then moved into container 101. This moving suitably occurs by means of a pump. This is preferably a recovery tool, wherein the decompacted toner residue is again mixed, so as to convert it again into fresh toner. The resulting mixed toner is thereafter moved into a main tank 102, which furthermore serves to control the concentration of marking particles and/or dispersing agent in the liquid toner. Thereto, main tank 102 is provided with inlets from a tank 103 with a concentrate of liquid developer dispersion and from a tank 104 with carrier liquid, optionally comprising dispersing agent. The main tank 102 is further provided with an outlet, from which liquid toner is transferred to the tank 100.

It will be understood that the above sequence of tanks is deemed an advantageous configuration that may also be used in combination with the embodiments shown in FIGS. 1 and 2. Alternatively configurations are however not excluded.

Figure 3:
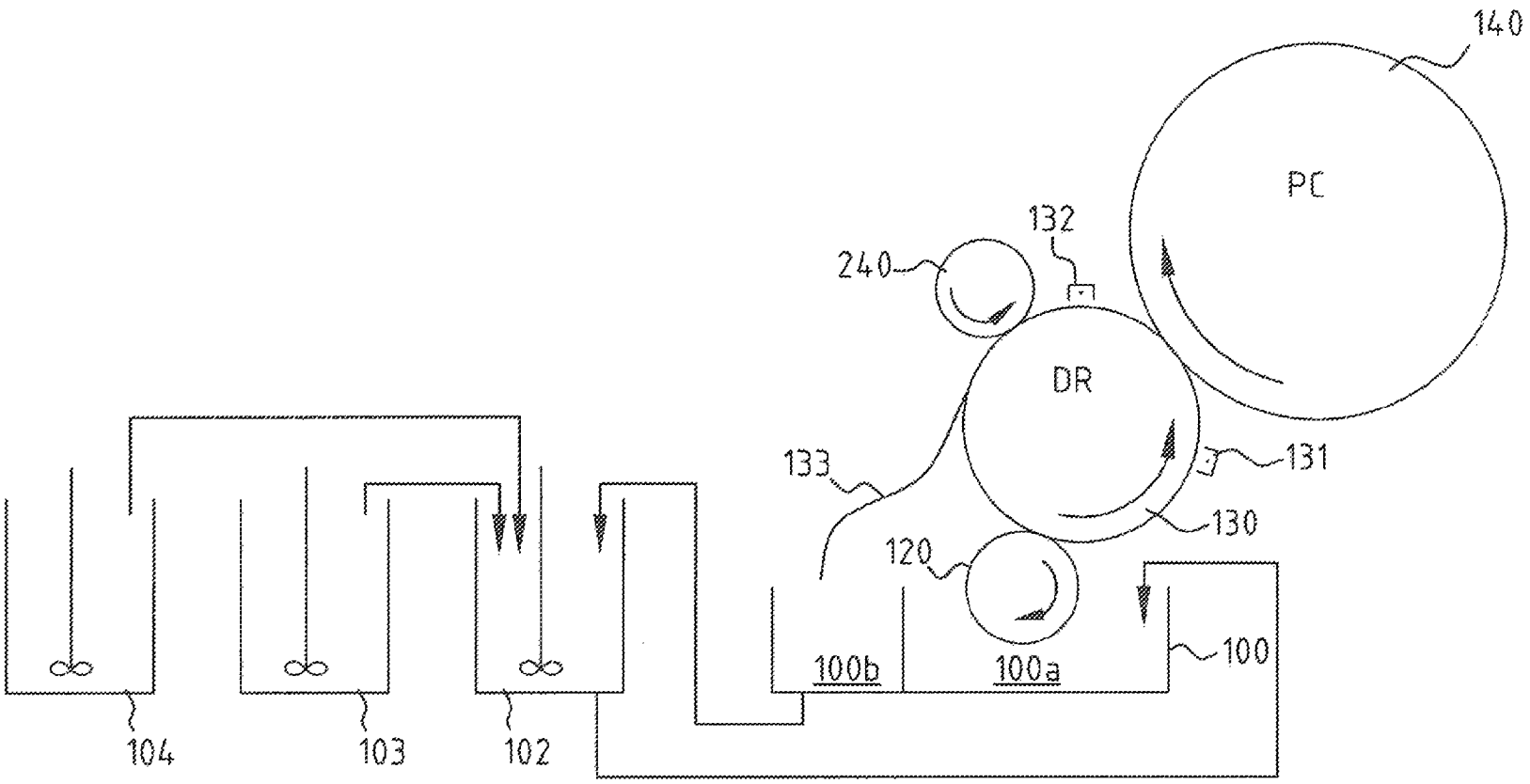
FIG. 3 is a schematic view illustrating a third embodiment of the invention.

FIG. 3 shows a further embodiment that differs from the embodiment shown in FIG. 2 in the configuration of tanks and reservoirs. In this embodiment, the recovery tool 101 as shown in FIG. 2 is integrated into the reservoir 100. Thereto, this reservoir 100 is subdivided into a first part 100*a* and a second part 100*b*. The first part 100*a* serves as tank for the fresh liquid toner, and contains a bath from which the fresh liquid toner is taken up on the surface of the feed member 120. The second part 100*b* serves as a collector of the toner residue, as well as any circulated liquid toner that is used as a rinsing liquid. This configuration has the advantage that it is more compact. Moreover, if any material would not be transferred from the development member 130 to the removal device 133, this will nevertheless drop into the container 100*b*, rather than the container 100*a*.

Thus, in summary, the printing method of the invention comprises the step of removing material adhered to a removal device upon interruption or termination of printing. The removal device is substantially in contact with the development member that rotates during printing. Material that continues to flow over the removal device has been found to adhere to said removal device when flowing is discontinued. Such adhered material is found to accumulate as a sequence of layers, resulting in errors in the printing process. The method is particularly relevant in combination with a treatment step on the excess liquid developer dispersion, which is found to lower to viscosity so as to enable flow from the development member, such as a development roller, to the removal device. Herein, upon interruption or termination of printing, charging and decharging means are switched off and control means ensure that the development member is separated and isolated from the imaging member upon interruption, such that the development member may continue to rotate without transfer of liquid developer dispersion to the imaging member, but transfer the liquid developer dispersion to the removal device for rinsing. The invention also relates to a digital printing system configured for such process.

The invention claimed is:

1. A method of digitally printing using a liquid developer dispersion comprising marking particles in a carrier liquid, which marking particles comprise colored particles and a binder resin, which developer dispersion further comprises a dispersing agent of a polymeric nature comprising an anchoring part having a plurality of anchoring sites for adhesion to the surface of the marking particles and one or more stabilizing parts in the form of polymeric chains of non-polar nature initially extending into the carrier liquid, wherein excess liquid developer dispersion remains in non-image areas on a development member after transfer of charged liquid developer dispersion to an imaging member so as to create an image on the imaging member, which development member and which imaging member are mutually in rotational contact during said transfer, said excess liquid developer dispersion having an increased viscosity in comparison to the liquid developer dispersion prior to charging, comprising the steps of:

removing the excess liquid developer dispersion from the development member by means of a removal device, and rinsing the removal device, upon interruption or termination of the printing, with liquid developer dispersion applied on the development member that rotates without being in rotational contact with said imaging member, for removal of material adhered to the removal device, wherein the rinsing occurs with fresh, uncharged liquid developer dispersion.

2. The method as claimed in claim 1, further comprising, upon interrupting or terminating the printing, the steps of:

separating the development member from the imaging member to avoid transfer of liquid developer dispersion from the development member to the imaging member;

loading liquid developer dispersion onto a surface of the development member;

transporting the loaded liquid developer dispersion without intermediate charging to the removal device.

3. The method as claimed in claim 1, further comprising the step of controlling the application of rinsing liquid on the basis of operation information.

4. The method as claimed in claim 1, wherein the printing further comprises the steps of:

charging liquid developer dispersion to facilitate transfer thereof from the development member to the imaging member;

transferring the charged liquid developer dispersion from a surface of the development member via the imaging member to a substrate, wherein excess liquid developer dispersion remains present on the development member after said transfer, and treating the excess liquid developer dispersion so as to facilitate its removal from the development member.

5. The method as claimed in claim 4, wherein the treatment of the excess liquid developer dispersion comprises the addition of a dispersing agent.

6. The method as claimed in claim 5, wherein the dispersing agent is first added to an additional member that is, in use, in rotational contact with the development member, and is then transferred from the additional member to the development member.

7. The method of claim 4, wherein the charged liquid developer dispersion is transferred from a surface of the development member via the imaging member and any further member to a substrate, wherein excess liquid developer dispersion remains present on the development member after said transfer.

8. The method as claimed in claim 1, wherein the removal of material adhered to the removal device starts within 30 seconds after interruption.

9. The method of claim 8, wherein the removal of material adhered to the removal device starts within 15 seconds after interruption.

10. The method of claim 8, wherein the removal of material adhered to the removal device starts within 5 seconds after interruption.

11. The method as claimed in claim 1, wherein a pre-treatment is carried out on the development member upon starting printing by rinsing with liquid developer dispersion.

12. The method as claimed in claim 11, wherein the rinsing of the pre-treatment is carried out with uncharged liquid developer dispersion and without application of any charging or discharging to the liquid developer dispersion.

13. The method as claimed in claim 1, wherein the marking particles have a diameter of 0.5 to 4.0 micrometer.

14. A digital printing system comprising:

a reservoir for liquid developer dispersion;

an imaging member;

a development member which is in use rotating, said development and said imaging member being configured for transferring charged liquid developer dispersion from the development member via said imaging member to a substrate, wherein—in use—excess liquid developer dispersion remains present on the development member after transfer to said imaging member;

charging means configured for charging liquid developer dispersion applied onto the development member from the reservoir;

a removal device for removing of the excess liquid developer dispersion from the development member;

wherein the system is configured to have a first and a second state, in which first state the development member is in rotational contact with the imaging member and configured for transferring charged liquid developer dispersion to the imaging member, in which second state the development member is free of rotational contact with the imaging member and configured for transferring liquid developer dispersion to the removal device, wherein the system comprises:

means for separating the development member from the imaging member to avoid transfer of liquid developer dispersion to the imaging member, and control means for controlling the charging means and for controlling the means for separating the development member from the imaging member and the development member, so as to separate of the development member from the imaging member and to effect rinsing of the removal device with uncharged liquid developer dispersion only upon interrupting or terminating of printing.

15. The digital printing system as claimed in claim 14, wherein the imaging member and the development member are each provided with an electromotor configured for rotation of said members.

16. The digital printing system as claimed in claim 14, further comprising treatment means for treatment of said excess liquid developer dispersion on said development member, which treatment serves to facilitate removal of the excess liquid developer dispersion from the development member.

17. The digital printing system as claimed in claim 16, wherein said treatment means comprise an additional member that is, in use, in rotational contact with the development member, and means for addition of a dispersing agent to said additional member.

18. A digital printing system comprising:

a reservoir for liquid developer dispersion;

an imaging member;

a development member which is in use rotating, said development and said imaging member being configured for transferring charged liquid developer dispersion from the development member via said imaging member to a substrate, wherein—in use—excess liquid developer dispersion remains present on the development member after transfer to said imaging member;

charging means configured for charging liquid developer dispersion applied onto the development member from the reservoir;

a removal device for removing of the excess liquid developer dispersion from the development member;

wherein the system is configured to have a first and a second state, in which first state the development member is in rotational contact with the imaging member and configured for transferring charged liquid developer dispersion to the imaging member, in which second state the development member is free of rotational contact with the imaging member and configured for transferring liquid developer dispersion to the removal device;

wherein the system comprises control means for controlling the charging means to effect rinsing of the removal device with uncharged liquid developer dispersion only upon interrupting or terminating of printing.

19. The digital printing system as claimed in claim 18, further comprising treatment means for treatment of excess liquid developer dispersion on said development member, which treatment serves to facilitate removal of the excess liquid developer dispersion from the development member.

20. The digital printing system as claimed in claim 19, wherein said treatment means comprise an additional member that is, in use, in rotational contact with the development member, and means for addition of a dispersing agent to said additional member.

* * * * *